United States Patent [19]

MacLean

[11] 4,106,072

[45] Aug. 8, 1978

[54] CONTROL SWITCH RELAY AND CONTROL CIRCUIT MEANS

[75] Inventor: Alexander MacLean, Hingham, Mass.

[73] Assignee: Electro Switch Corp., Weymouth, Mass.

[21] Appl. No.: 729,114

[22] Filed: Oct. 4, 1976

Related U.S. Application Data

[62] Division of Ser. No. 591,170, Jun. 27, 1975, Pat. No. 4,001,740.

[51] Int. Cl.[2] ..... H01H 47/22

[52] U.S. Cl. ..... 361/156; 361/166; 361/191

[58] Field of Search ..... 361/156, 166, 191, 195, 361/206, 210, 189; 335/173, 190, 191

[56] References Cited

U.S. PATENT DOCUMENTS 2,429,131 10/1947 Lathrop ..... 361/195 X

FOREIGN PATENT DOCUMENTS 455,392 12/1974 U.S.S.R. ..... 361/195

*Primary Examiner*—Harry E. Moose, Jr.

*Attorney, Agent, or Firm*—Wolf, Greenfield & Sacks

[57] ABSTRACT

A control switch has a switch shaft mounted for reciprocal rotational movement about its axis. A cam profile is fixed to the shaft and has first and second opposed cam surfaces. A driver is mounted to selectively engage the first or second cam surface to drive the switch shaft into a first clockwise position or a second counterclockwise position by remote actuation. The driver is connected to a rotary solenoid which allows uni-directional drive translated into two directional drive by the driver.

A control circuit provides rapid actuation and slow release of the rotary solenoid along with operation of a linear solenoid when desired to select between first and second directional movement of the cam profile. The control circuit permits charging a capacitor while rapidly actuating a relay to actuate the rotary solenoid. A resistor provides for slow discharge of the capacitor to maintain the relay actuated over a slow release period after disruption of the charging circuit. A linear solenoid is interconnected with the charging circuit to enable selective actuation of the linear solenoid when desired to switch directional movement of the cam profile.

7 Claims, 10 Drawing Figures

FIG. 1
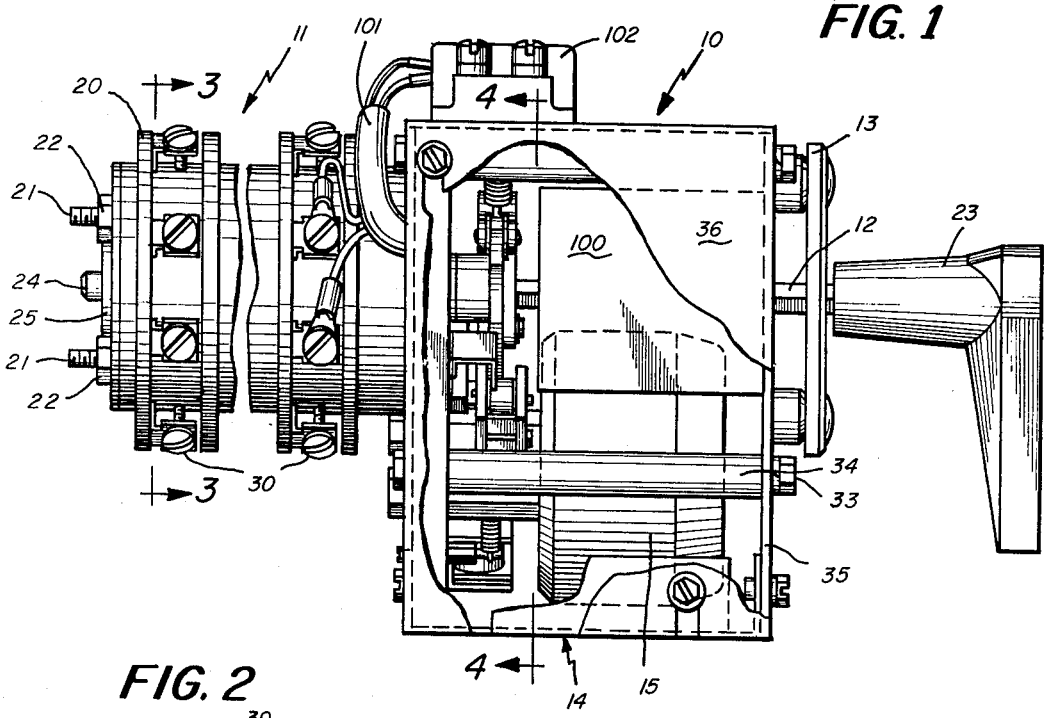
FIG. 2
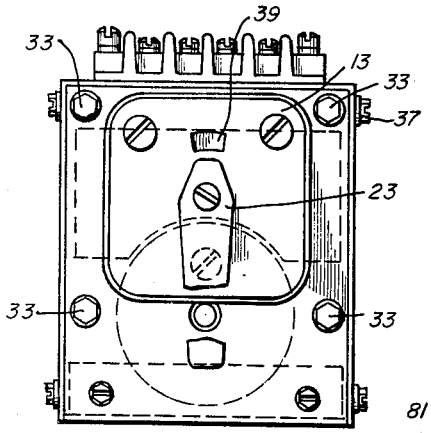
FIG. 4
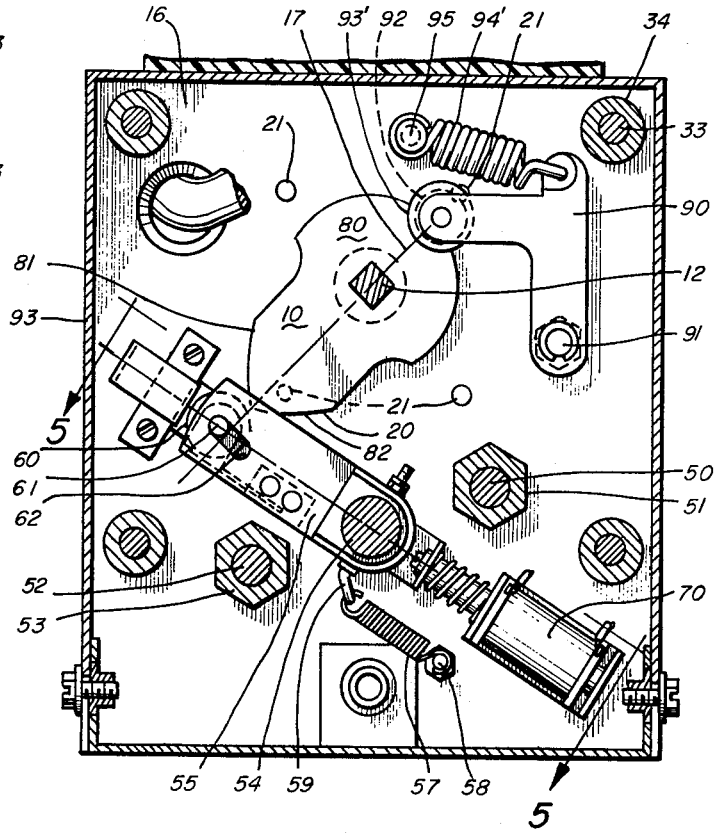
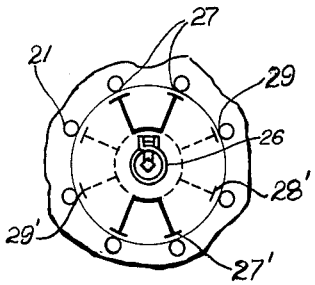
FIG. 3

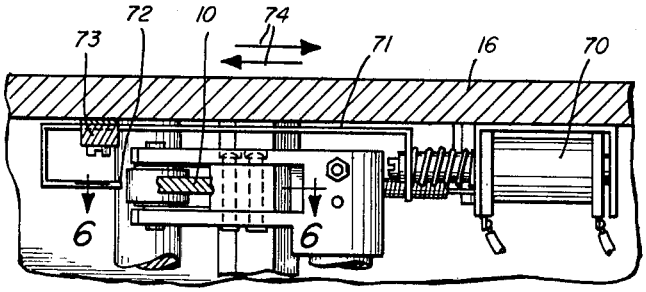
FIG. 5
FIG. 6
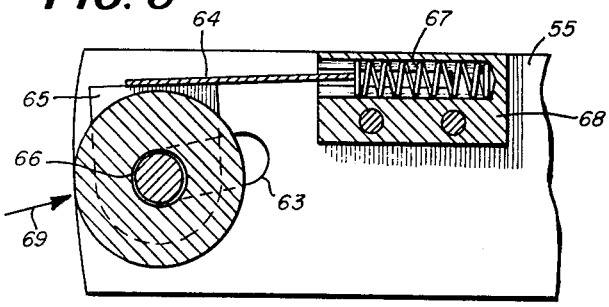
FIG. 10
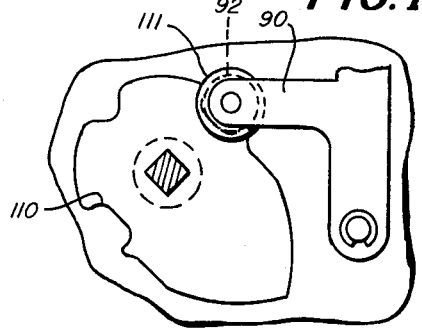
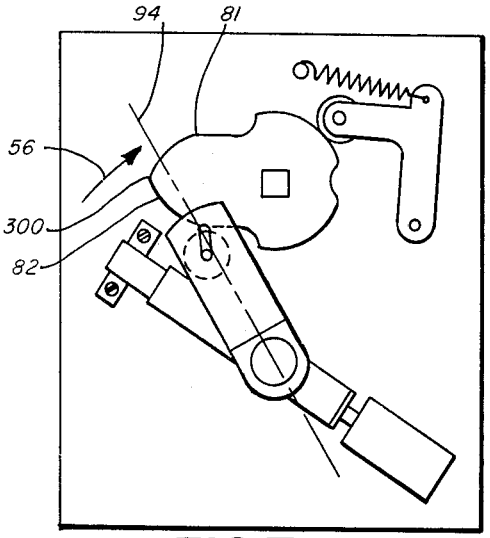
FIG. 7
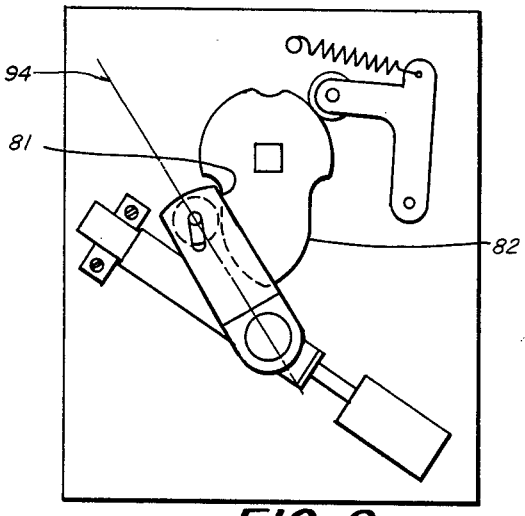
FIG. 8
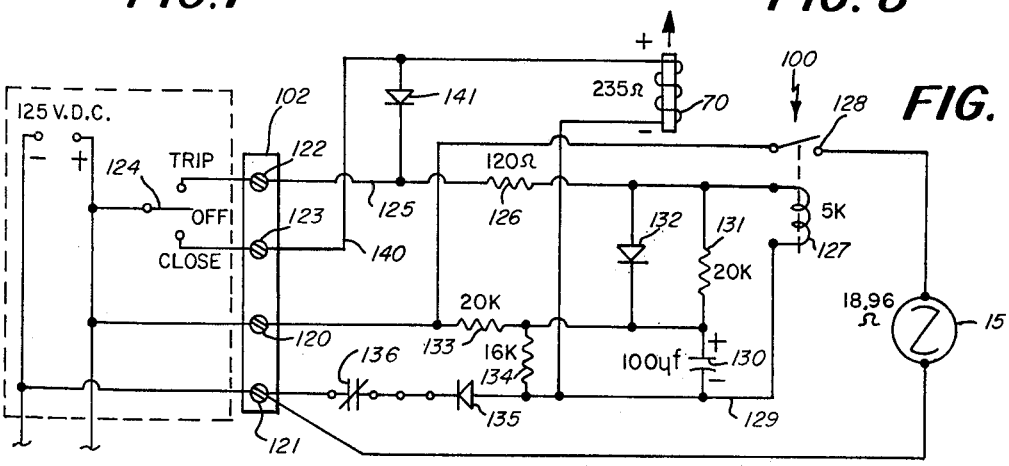
FIG. 9

CONTROL SWITCH RELAY AND CONTROL CIRCUIT MEANS

RELATED APPLICATION

This application is a division of applicant's copending application Ser. No. 591,170, filed June 27, 1975, now U.S. Pat. No. 4,001,740.

BACKGROUND OF THE INVENTION

Manually operated control switches are well-known for use by electric utility industries. Such control switches sometimes referred to as circuit breakers and control switches, are used as a primary means of manually tripping out circuit breakers to isolate a power highline from an overall distribution system. The same control switch is often used as the primary means of manually closing or reclosing a power circuit breaker. Such control switches are normally panel mounted in large groups on predrilled panels and have handle shafts extending through the panel for manual operation at the panel. Often such switches provide up to fourteen 30 amp contacts that can be operated in one of three positions. Typically, these are trip, neutral and close or 315 degrees, 0° and 45°, respectively. The switch is at rest in the neutral position (0°) maintained by a spring load. From this position the switch can be turned 45° to either the trip or close position depending upon the function required. Such counterclockwise or clockwise turning is against a resilient spring load in either direction so that the handle is always resiliently biased to return to the neutral position. Typically, the operation of the switches in either tripping or closing is very quick, often only a few seconds. Thus the control switch need only be manually held out of the neutral position against the spring load for a few seconds to do its job and then be allowed to return to the neutral position. Such positional contacts are considered momentary contacts; thus, they only close for a moment and then open. Occasionally a fourth position is supplied at 270° as in a syncroscope switch; however, the contacts for the fourth position are maintained by a locking detent that prevents the switch from returning to neutral.

The wide use of these control switches throughout industry has created a great many panel installations. Thus panels throughout the country are drilled, switches are mounted and wiring established. Installation or replacement of such systems today would require significant cost. Because of certain technological advances, it has become important for the industry to change the old systems over from a manual control at the switch site to enable such switches to be automatically or remotely controlled as well as manually controlled at the switch site. Thus, there is a need in the industry for a control switch that can be both manually actuated at the switch and/or automatically controlled from a remote location, which switch would be sized to fit existing panel installations with no or minimum modifications.

SUMMARY OF THE INVENTION

It is an object of this invention to provide a control switch which can be used to directly replace in-service circuit breaker and control switches yet has a remote actuation capability.

Another object of this invention is to provide a control switch in accordance with the preceding object which provides for manual operation identical to conventional units with electrical contacts having identical modes of operation as those of manual units.

Still another object of this invention is to provide a control switch in accordance with the preceding objects which has a remote actuation mechanism without direct mechanical linkage to the manual operation components so that if the remote mechanism should fail, manual operation will always be possible.

Still another object of this invention is to provide a control circuit for a control switch relay in accordance with the preceding objects which control circuit allows interruption of rotary solenoid power while avoiding problems associated with excessive arcing.

Still another object of this invention is to provide a control circuit in accordance with the preceding objects which provides for the use of a low power command signal and has provision for limiting the time of rotary solenoid operation to prevent damage due to overheating.

Still another object of this invention is to provide a control circuit in accordance with the preceding objects which permits rapid actuation of an output means with delayed release or deactuation of the output means as desired.

According to the invention a control switch has a switch shaft mounted for reciprocal rotational movement about its axis from a first rest position to a second clockwise position and a third counterclockwise position. A cam profile means is fixed to the shaft and has first and second opposed cam surfaces. Means are provided for retaining the cam profile means with the switch shaft in the first rest position. Drive means comprises a means for selectively engaging the first and second cam surfaces to drive the switch shaft to the second and third positions respectively. The drive means further comprises a uni-directional rotary solenoid providing arcuate reciprocation of a drive arm. Preferably the drive arm carries a drive roller having an axis parallel to the switch shaft which roller is mounted for movement into operative relationship with the first or second cam surface as may be selected. Preferably a linear solenoid is provided for moving the drive roller to the desired operative engagement.

A control circuit for the control switch relay has rapid actuation and slow release of the rotary solenoid. A first circuit means enables charging of a charging means such as a capacitor while actuating a bistable means such as a relay to actuate the rotary solenoid. Second circuit means such as a resistor acts to allow slow discharge of the charging means to maintain the bistable means actuated over a slow release peroid. Preferably a second output means such as a linear solenoid is connected to the control circuit in line with the first means for charging the capacitor and includes a back-biased unidirectional conductive device such as a diode.

It is a feature of this invention that the control switch relay can replace conventional manually operated switches using similar electrical connections and identical predrilled panel mounts and the like, thus reducing installation and assembly costs. The control switch relays permit identical manual operation at the switch as previously known with manual switches, while also permitting automatic or remote operation when desired. There is no direct mechanical linkage between the conventional switch shaft and remote drive mechanisms so that failure of the remote mechanism does not impair the ability of the switch to be manually operated. The control circuit avoids switching and arcing problems normally associated with rotary solenoids usage. For remote control the command signal needed can be low power thus eliminating line losses due to $I^2R$ over long cable runs. Power supplies to the rotary solenoid can be designed as for example with 5 second maximums per cycle to prevent heat damage. Rapid actuation and slow release time of the rotary solenoid can be designed into the circuit. Minimized cost and expense with maximized switching ability and versatility are present in the control switch relays of the present invention.

BRIEF DESCRIPTION OF THE DRAWINGS

The above and other objects, features and advantages of the present invention will be better understood from the following specification when read in connection with the accompanying drawings in which:

FIG. 1 is a side view of a control switch relay in accordance with a preferred embodiment of the present invention;

FIG. 2 is a front view thereof;

FIG. 3 is a partially semidiagrammatic cross sectional view through line 3—3 of FIG. 1;

FIG. 4 is a cross sectional view taken through line 4—4 of FIG. 1;

FIG. 5 is a cross sectional view taken through line 5—5 of FIG. 4;

FIG. 6 is a cross sectional view taken through line 6—6 of FIG. 5;

FIGS. 7 and 8 are views similar to FIG. 4 showing the basic elements of the combination in two different operative positions;

FIG. 9 is a semidiagrammatic circuit diagram of the control circuit of this invention; and FIG. 10 is a partial view of a modified cam in a combination of an alternate embodiment of this invention.

BRIEF DESCRIPTION OF PREFERRED EMBODIMENTS

With reference now to the drawings and more particularly FIGS. 1–4, a control switch relay is illustrated generally at 10 and has a conventional switch body 11 carrying a switch shaft 12 passing through a front indicator panel 13 to the rear of the body 11. An automatic remote actuation section 14 has a rotary solenoid 15 mounted on a base mounting plate 16.

The body portion 11 is substantially conventional in known rotary relay switches and comprises plastic discs 20 held together by four through rods 21 and associated nuts 22. The switch shaft 12 preferably has a square cross section with an actuating handle 23 at one end and an inner end 24 passing through an end plate 25 having a conventional torsion spring 26 resiliently biasing the shaft into the neutral position shown in FIGS. 1–4. Rotation of the handle 23 either clockwise or counterclockwise is against the force of spring 26 which tends to return the shaft to the position shown in FIGS. 1–4. The shaft 12 carries momentary contacts 27, 27′ shown in full line in FIG. 3 in a rest or first position and in dotted line at 28, 28′ in a second or clockwise rotational position with a third counterclockwise position being indicated at 29, 29′. Positions 28,28′ and 29,29′ are momentary contact positions. Suitable outer contacts 30 as known in the art interconnect with the positions 28 and 29 as is well known. In a specific embodiment of this invention, 8 rows of contacts are spaced at 45° intervals about the circumference of the circular body section 11 with 7 contacts in each row. The number of contacts can vary depending upon the particular usage of the device.

Bolts 33 with enlarged diameter space sleeves 34 mount a front plate 35 to which is screwed a U-shaped housing section 36 held in place by set screws 37 suitably positioned about the device. A conventional front plate 13 mounts a trip signal 39 as known in the art.

The above described elements are substantially as previously used by the art in control and circuit breaker switches of this type.

Turning now to the automatic remote section 14, base mounting plate 16, carries lugs 50 and 52 with associated spacer sleeves 51 and 53 respectively for firmly holding in place a rotary solenoid 15 which acts as the principal source of mechanical drive power for remote operation of the switch 10. In the preferred embodiment, the rotary solenoid is an 18.96 ohm solenoid. Rotary solenoids are selected because inherently these devices are highly efficient in their conversion of electrical energy to mechanical energy. A great deal of mechanical power is provided with the solenoid taking up a relatively small space. Such solenoids are capable of rapid operation in the nature of 20 milliseconds and can deliver for example 45 inch/pounds of torque. As is known, such rotary solenoids have an output rotation of a fixed angle in one direction only, that is, they are uni-directional drives.

An output shaft 54 of the solenoid comprises part of a drive means which includes a drive arm 55 capable of reciprocal angular movement in the direction of arrow 56 (FIG. 7). The drive arm 55 is fixed to the output shaft 54 and biased to the rest position shown in FIG. 4 by a spring 57 attached to a post 58 on the base plate and a hook end of bolt 59 of the drive arm. A drive roller 60 is mounted for rotation about a roller pin 61 having ends extending into opposed side slots 62 and 63. A spring loaded extension 64 has side arms 65 in a U shape with circular cutouts 66 engaging the roller pin 61 at either end thereof. The member 64 is spring biased by a spring 67 mounted in the arm 55 by a mounting block 68. Spring 67 constantly urges member 64 with associated roller pin 61 into the outer extreme end of the slots 62, 63. When a force is applied in the direction of arrow 69 (FIG. 6), the roller and associated pin will slide in the slots 62, 63 to the inner end thereof allowing rotation of the roller at either extreme of the slots 62, 63.

A linear solenoid 70 is fixedly attached to the base mounting plate 16 and has a metal bent leaf member 71 which is substantially rigid and bent back on itself as at 72. Member 71 is mounted by a slide block 73 for reciprocal motion in the direction of arrows 74. The rest position of the linear solenoid 70 is shown in FIG. 4 and FIG. 8 with the roller biased to its outermost position by the spring 67. When the linear solenoid 70 is actuated, it slides member 71 toward itself thereby causing end 72 to push the roller 60 against the bias of spring 67 to the position shown in FIG. 7.

The switch shaft 12 has a cam profile means 80 fixed to it and mounted adjacent the roller 60 with a first cam profile surface 81 and a second substantially mirror image cam profile surface 82 adapted to be engaged by the roller 60 in alternate positions of the roller 60 as shown in FIGS. 7 and 8. Surfaces 81 and 82 differ slightly in slope to obtain substantially the same mechanical output of the cam in either direction of movement. Clockwise or counterclockwise rotation of the cam means 80 causes corresponding rotation of the switch shaft 12. Cam 80 has a center line 17 (FIG. 4)

which in the at rest position of the cam and solenoid 70, passes slightly to the right side of the axis of roller pin 61 as shown in FIG. 4. In the activated position of the solenoid 70, the roller pin 61 is moved so that the fixed center line 17 now appears slightly to the left of the center line of roller pin 61. Thus, if the drive arm 55 is actuated when the roller pin is in the position of FIG. 4, the cam will rotate the shaft as shown in FIG. 8 while if the drive arm is actuated when the solenoid 70 is actuated with the roller in the position shown in FIG. 7, the shaft will be rotated counterclockwise rather than clockwise.

A detent 90 in the form of an L-shaped dog is mounted for rotation about a post 91 retained on the base mounting plate 16. One arm of the detent 90 carries a rotatably mounted detent roller 92 adapted to engage a notch 93' in the cam. The detent 90 is resiliently urged against the cam at all times by a spring 94' mounted to a fixed post 95 extending from the base mounting plate 16. Thus, the detent 90 positively positions the cam in the at rest position with the center line 17 in a fixed position with respect to the roller 60. This is important since the center line 17 must always come to substantially the same position in order to enable selective actuation by the roller in either of the roller positions. Preferably the axially extending center line of each of slots 62 and 63 are perpendicular to the center line 17 which substantially eliminates the possibility of the roller striking the point of the cam in normal operation. In the preferred embodiment, a clearance of 0.02 inch between the cam peak 300 and the roller 60 occurs during thhe transition from one slot extreme to the other.

In the preferred embodiment, the rotary solenoid has an output of 25 degrees, thus, the drive arm 55 indexes 25 degrees between center line 93 (FIG. 4) in the at rest position and center line 94 in the activated positions of FIGS. 7 and 8. The roller 69 is spring loaded so that its center of rotation lies 3/32 inch off the center line 17 in the at rest position of FIG. 4. When indexing 25°, the roller pin 61 moves out away from the center line 17 reaching a maximum distance when it is coincident with a center line halfway between center lines 93 and 94. Thus a center line halfway between 93 and 94 is perpendicular to center line 17 of the cam profile. The advantage of this arrangement causes the pin 61 to move in what nearly approaches a straight line which in turn is parallel to the center line 17. This provides a minimum change in the drive momentum, that is, inch/pounds/-torque delivered to the cam for clockwise and counterclockwise rotation. A potted circuit 100 for activating the solenoids, is mounted between plates 16 and 35 with leads 101 attached to a terminal block 102.

The mechanical operation of the parts upon electrical actuation as will be described, is relatively uncomplicated. The at rest position is shown in FIG. 4 where the cam switch shaft 12 is in its resiliently biased neutral position locked positively in place by the detent 90. Drive arm 55 is in its at rest position as shown in FIG. 4 and slight spring pressure (2–3 ounces) urges the roller 60 into its outermost position. If it is desired to move the drive shaft 12 and associated contacts counterclockwise, suitable circuitry is activated to rotate the drive arm 25 degrees as shown in FIG. 8. This causes roller 60 to contact cam surface 81 and rotate the cam 45° counterclockwise. The rotary solenoid holds the cam at 45° until it is deenergized. It is preferred to keep the control switch relay energized for 3 seconds to simulate what would normally be encountered in manual operation. The roller pin is captive in the slots 62, 63 and thus roller 60 contacts surface 81. The roller 92 rides along the rear cam surface of the cam 80. Upon deactuation of the rotary solenoid, the resilient spring pressure brings the cam 80 back to the at rest position of FIG. 4 while the spring 57 aids in bringing the drive arm back to its at rest position shown in FIG. 4. During the rotational movement of the drive arm, roller 60 is held in place by the high force of the driving action as well as a few ounces of spring bias which spring bias has little effect during the driving action.

When it is desired to move the shaft clockwise, it is necessary to first actuate the linear solenoid 70. This slides the member 71 so that end 72 moves to the right as shown in FIG. 5 sliding the roller pin 61 in the slots 62, 63 against the force of spring 67. While the member 71 is maintained at its rightmost position, the arm 55 is actuated to its rotational movement by the rotary solenoid causing cam surface 82 to be engaged whereupon the roller 60 is locked in its innermost position by the driving force with the action occurring as shown in FIG. 7.

In each mode of operation described above, resilient spring pressure returns the parts to the at rest position. FIG. 10 shows an alternate embodiment of the invention in which the spring loaded detent 90 is used to lock the switch shaft in a desired position. All parts are identical to those described above except that the cam 80 is provided with two additional opposed locking notches 110 and 111. The notches are arranged so that 90° rotation of the shaft 12 during manual operation will allow 111 or 110 to engage roller 92 for locking depending upon the direction of movement of the cam and hold the switch in fixed position. The manual feature allows movement to 90° and/or 270° to get the same contact actuation as 45° or 315° respectively with locking in place rather than momentary contact. The switch can then be manually operated to return it to the rest position. Locking motions of this type are sometimes desired in syncroscope switches as known in the art.

Turning now to the circuitry associated with the control switch relay in accordance with the preferred embodiment of this invention, the terminal block 102 carries constant power supply terminals 120 and 121 along with separate input terminals 122 and 123. Terminals 120 and 121 are connected to 25 volt direct current power source. A switch at a remote location (124) enables selection of trip and close circuitry.

The trip circuit runs through line 125 to a 120 ohm, 1 watt resistor 126 interconnected with a two state bistable means in the form of a relay 127 for closing a normally opened switch 128. The relay 127 has one connection to line 129 carrying one side of a charging means in the form of a condenser 130 connected back to line 125 through a 20,000 ohm, 1 watt resistor 131 forming a part of a high resistance path when the capacitor 130 is discharged. The capacitor 130 in the preferred embodiment is a 100 microfarad, 150 WDC capacitor (electrolytic). A unilateral conductive device such as a forwardly biased 600 PIV, 1 amp diode 132 is interconnected between line 125 and the capacitor 130. The lead from the diode passes back through a voltage divider in the form of resistors 133 and 134 to terminal 120. Line 129 includes a forwardly biased diode 135 which can be a 600 PIV, 1 amp diode. A contact 136 is located in the negative line 129.

The rotary solenoid 15 is actuated upon closure of the normally opened switch 128 by the relay 127.

The close circuitry includes line 140 from contact 123 to the linear solenoid 70 which is interconnected with a negative line 129. A unilateral conduction device in the form of a back-biased 600 PIV, 1 amp diode 141 is interconnected with line 140 passing to line 125.

The circuit 100 requires only four wires to be connected to the control switch relay. The operating cycle from the neutral to the trip or close position and back to the neutral position is automatic. A momentary closure of the trip switch 124 for a minimum of 50 milliseconds closes the control switch relay to index to the desired position where it remains for 3 seconds and then returns to the neutral position. When the trip position is commanded, cirrent flows through resistor 126 charging the capacitor 130 through the forwardly biased diode 132 while resistor 126 limits the current charge to 1 amp to protect the contacts of the switch. The capacitor 130 charges very quickly approaching the source value of 125 VDC. Simultaneously to the source voltage developing across the capacitor it also develops across the relay 127. The buildup of voltage across the parallel branch is in accordance with the expodiential curve for charging capacitors as known in the art. At approximately 95 volts the relay 127 starts to pull in and actually closes its contact switch 128 at 118 volts. This initiates rotation of the rotary solenoid 15 and the control switch relay indexes to the trip position opening the negative line at the control relay switch contact 136. Because the diode 132 shunts resistor 131, the capacitor 130 is fully charged when the control switch relay contact 136 opens 60 milliseconds after the switch 124 is initially closed to the trip position. This provides a fast operating time but a slow release time (3 second release). When the contact 136 opens, the capacitor 130 holds the relay 127 closed by discharging through the 5 K ohm coil resistance of the relay and the series resistor 131. This is a high resistance discharge path for the capacitor in contrast with the low resistance charging path through diode 132. Thus the circuitry allows slow release of the relay but fast operate times as in the nature of 50 milliseconds. Contact switch 136 is a normally closed switch in the 0 or neutral position and is opened by the switch shaft indexing out of neutral to either 45° or 315°.

Relay 127 allows for interruption of the rotary solenoid power in a manner which does not cause severe arcing problems which might otherwise be the case when switching a rotary solenoid. For remote control the command signal to the relay need only be low power allowing elimination of any line loss due to $I^2R$ over long cable runs. The relay further provides a 5 second maximum power supply to the rotary solenoid thus preventing overheating and subsequent damage to the solenoid.

It should be noted that when line 124 is in the trip position the linear solenoid does not operate because of the backbias on diode 141 which blocks any current flow to the solenoid 70.

When switch 124 is operated to the close position, the linear solenoid 70 is actuated and by the control linkage member 71 which shifts the roller 60 to the other side of center line 17. In this position diode 141 is forwardly biased and therefore conducts. This causes current to flow through resistor 126 to operate the relay 127 as previously explained. It is important that the close position enable the linear solenoid 70 to complete its 3/16 inch travel before the rotary solenoid is energized. This enables prepositioning of the roller before mechanical force is applied by the rotary solenoid. The use of resistor 126 assures this delay. The linear solenoid completes its stroke in 10 milliseconds and the value of resistor 126 has been selected to slow down the operation of the relay 127 so that the contacts at 128 do not close for approximately 40 milliseconds providing a safety factor of 4.

Resistors 133 and 134 act as a voltage divider so that the capacitor 130 can be energized continually at for example 40 volts. This voltage serves to maintain the dielectric of the capacitor through long periods of inactivity of the control switch relay. If completely discharged for long periods of time and charged up quickly, unwanted failures of the capacitor might result. The 40 volt continuous charge is based on two prime factors. If higher voltages are used the operating time of the relay would decrease and approach the operating time of the linear solenoid thus reducing the safety factor described above. With the capacitor continuously charged, a continuous voltage exists across the relay coil. This is less than 40 volts but also must be less than the relay dropout voltage. If it is not, any false closure of the relay contacts due to mechanical shock or vibration could result in the relay mechanically sealing in which would cause the control switch relay to index to the trip position momentarily.

Diode 135 is used to prevent a reverse polarity hookup from destroying the other diodes and electrolytic capacitor which are polarity sensitive. Reverse hookup of plus and minus only back-biases diode 135 preventing current flow and thus preventing any damage.

While specific embodiments of the present invention have been shown and described above, modifications are possible. Roller 60 could be a ball bearing or sliding surface if desired although a roller is preferred. The particular values of the electrical components and the circuitry used can vary depending upon the particular application. Similarly the number of contacts in the switch and the purpose of the switch can also vary as may be required for particular applications.

What is claimed is:

1. A control circuit means for providing rapid actuation and slow release of a rotary solenoid, said control circuit comprising, a first circuit means for charging a capacitor while actuating a relay to actuate said rotary solenoid, second circuit means for causing slow discharge of said capacitor to maintain said relay over a slow release period, a second output means connected to said control circuit in parallel with said first means for charging said capacitor through a unilateral conduction device, and switch means for selectively passing different levels of current to said second output means or directly to said capacitor.

2. A control circuit means in accordance with claim 1 wherein said unilateral conduction device is in series with resistor means for permitting actuation of said second output means prior to actuation of said rotary solenoid when said current is first passed to said second output means.

3. A control circuit means in accordance with claim 2 wherein said unilateral conduction device is a diode.

4. A control circuit means for providing rapid actuation and slow release of a rotary solenoid, said control circuit comprising, a first circuit means comprising a forwardly biased diode having a low resistance charging path for charging a capacitor while actuating a relay to actuate said rotary solenoid, a resistor for causing slow discharge of said capacitor to maintain said relay over a slow release period, a second output means connected to said control circuit in parallel with said first means for charging said capacitor through a back-biased unilateral conduction device, and switch means for selectively passing current first to said second output means or directly to said first circuit charging means.

5. A control circuit means in accordance with claim 2 and further comprising circuit means for maintaining a constant low voltage charge on said capacitor.

6. A control circuit means in accordance with claim 3 and further comprising an electrical contact carrying switch shaft positioned and arranged to be rotated into selected positions by operation of said rotary relay.

7. A control circuit means in accordance with claim 4 wherein said back biased unilateral conduction device prevents current flow from said first circuit means to said second output means and permits current flow from said second output means to said first circuit means.

* * * * *